United States Patent [19]

Tanaka

[11] Patent Number: 4,721,442

[45] Date of Patent: Jan. 26, 1988

[54] FUEL INJECTION PUMP

[75] Inventor: Noritoshi Tanaka, Higashi-Matsuyama, Japan

[73] Assignee: Diesel Kiki Co., Ltd., Tokyo, Japan

[21] Appl. No.: 848,960

[22] Filed: Apr. 7, 1986

[30] Foreign Application Priority Data

Apr. 17, 1985 [JP] Japan ..... 60-57321

[51] Int. Cl.[4] ..... F04B 7/04; F04B 39/10; F02M 59/20

[52] U.S. Cl. ..... 417/499; 123/500; 123/503

[58] Field of Search ..... 417/494, 499; 123/500, 123/501, 503

[56] References Cited

U.S. PATENT DOCUMENTS

| | | | |
|---|---|---|---|
| Re. 20,573 | 12/1937 | L'Orange | 417/494 |
| 2,348,282 | 5/1944 | Bremser | 417/494 |
| 2,384,011 | 9/1945 | Bremser | 417/494 |
| 2,384,012 | 9/1945 | Bremser | 417/494 |
| 2,420,164 | 5/1947 | Bremser | 417/494 |
| 2,551,053 | 5/1951 | Rogers | 417/494 |
| 2,810,375 | 10/1957 | Froehlich | 417/494 |
| 3,403,629 | 10/1968 | Eheim | 417/499 |
| 4,413,600 | 11/1983 | Yanagawa | 417/494 |

*Primary Examiner*—Carlton R. Croyle
*Assistant Examiner*—Jane E. Obee
*Attorney, Agent, or Firm*—Wenderoth, Lind & Ponack

[57] ABSTRACT

A fuel injection pump has a control sleeve slidably fitted over a plunger. The plunger is provided with two lateral holes and an inclined groove open to and extending between respective ends of said lateral holes. The end of injection occurs when the inclined groove communicates with a cut-off port formed in the control sleeve, and the timing of injection is adjustable by the rotation of the plunger. To keep fuel noninjected, the plunger is rotated to a position at which the second lateral hole is brought into communication with the cut-off port.

3 Claims, 6 Drawing Figures

FUEL INJECTION PUMP

BACKGROUND OF THE INVENTION

1. Field of the Invention

The present invention relates generally to a fuel injection pump and, more particularly, to a fuel injection pump having a mechanism for the adjustment of fuel injection timing.

2. Prior Art

Such a type fuel injection pump is known in the art, as disclosed in, for instance, Japanese Utility Model Kokai-Publication No. 57 (1982)-142167. According to the fuel injection pump disclosed therein, a control sleeve is slidably fitted over a plunger to control the injection of fuel by varying the relative positions of the control sleeve and the plunger. FIGS. 5 and 6 show a conventional example of such a fuel injection pump.

Referring to FIGS. 5 and 6, a plunger 8 is rotatable and reciprocatable within a plunger barrel 3. A control sleeve 24 is slidably fitted over the plunger 8. The plunger 8 is provided with a longitudinal hole 31 which is open at one end in a fuel-pressurizing chamber 9 located thereabove, an inclined groove 40 on the outer face thereof, which is in communication with the longitudinal hole 31, a longitudinal groove 41 which is formed at one end of the inclined groove 40 and extends along the axial direction of the plunger 8, and a lateral hole 42 which is located at the lower end of the longitudinal groove 41 and is open to the longitudinal hole 31. On the other hand, the control sleeve 24 is moved vertically by the rotation of a control rod 43 engaging therewith, and is provided therein with a cut-off port 36. In such an arrangement as mentioned above, when the plunger 8 is rotated by means of a mechanism for regulating the amount of fuel to be injected (not shown), there is a change in the distance (effective stroke from the closing of the lateral hole 42 in the plunger 8 by the control sleeve 24 to the alignment of the inclined groove 40 in the plunger 8 with the cut-off port 36 in the control sleeve 24) whereby the amount of fuel to be injected is adjusted. When the control sleeve 24 is vertically moved by the control rod 43, on the other hand, there is a change in the distance (prestroke) from the initiation of ascent of the plunger 8 to the closing of the lateral hole 42 in the plunger 8 by the control sleeve 24, whereby the timing of fuel to be injected is adjusted. The provision of the longitudinal groove 41 in the plunger 8 is to keep fuel in a noninjected state. When the plunger 8 is rotated to allow the longitudinal groove 41 and the cut-off port 36 to be positioned within the same plane, they are open to each other before the lateral hole 42 in the plunger 8 is closed by the control sleeve 24, so that the fuel-pressurizing chamber 9 communicates with a fuel reservoir chamber (not illustrated) by way of the longitudinal hole 31, inclined groove 40 and longitudinal groove 41 in the plunger 8 as well as the cut-off port 36 in the control sleeve 24, thereby keeping the fuel in a noninjected state.

However, since the prior art arrangement as described above is of the structure that the inclined groove 40 in the plunger 8 is directly open to the longitudinal hole 31 extending therein, a relatively large diameter of the longitudinal hole 31 is required. This results in the relatively large volume of a portion of the fuel-pressurizing chamber 9 from which an amount of fuel escapes during pumping, i.e., the dead volume, and is responsible for a drop in the performance of the fuel injection pump such as a lowering of the pressure of fuel to be injected.

SUMMARY OF THE INVENTION

One object of the present invention is to provide a fuel injection pump which has improved performance by decreasing a structural dead volume.

Other objects of the present invention are to improve means for keeping fuel noninjected and to facilitate processing of a plunger.

More specifically, the present invention provides a fuel injection pump comprising a plunger and a control sleeve slidably fitted thereover and designed to control the injection of fuel by varying the relative positions of the control sleeve and the plunger, wherein said plunger includes a longitudinal hole which extends in and is open at the upper end of said plunger, first and second lateral holes which are connected to said longitudinal hole, and an inclined groove which is open between and connects the ends of said first and second lateral holes which are in turn open to the outer surface of said plunger, said connection being made on the outer surface of said plunger, and said control sleeve communicates with one of said second lateral hole and said inclined groove, and includes a cut-off port for venting the fuel to be injected.

As is the case with the prior art, therefore, it is the end of injection when the inclined grooved formed in the plunger is in registration with the cut-off port formed in the control sleeve. However, since the longitudinal hole and inclined groove formed in the plunger are connected to each other by way of the first and second lateral holes formed in the plunger, the longitudinal hole in the plunger can have a relatively small minimum diameter for assuring the flow rate of fuel required for injection. Unlike the prior art, the provision of any longitudinal groove is dispensed with, since noninjection is achieved through the second lateral hole. For these reasons, the aforesaid objects are accomplished.

Many other advantages, features and additional objects of the present invention will become manifest to those versed in the art upon making reference to the detailed description and the accompanying sheets of drawings on which preferred structural embodiments incorporating the principles of the invention are shown by way of illustrative example.

DETAILED DESCRIPTION

Figure 1:
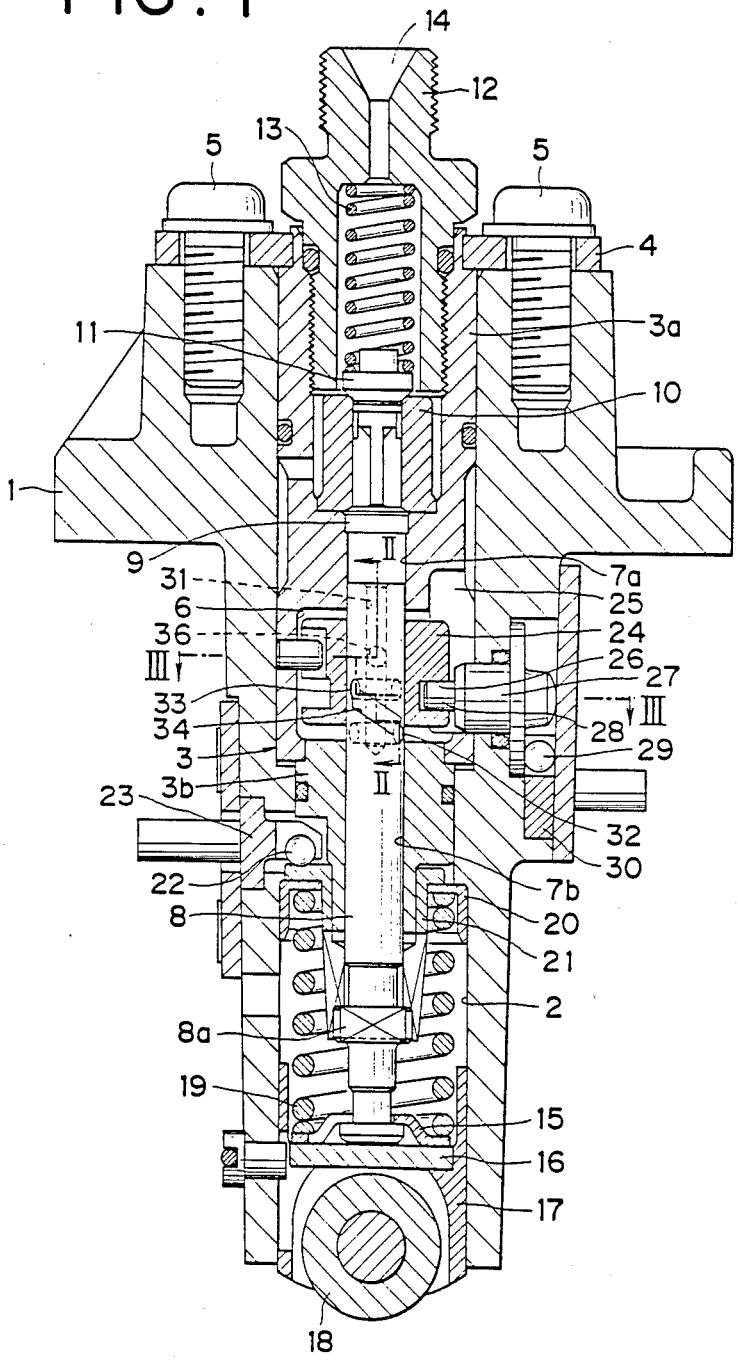
FIG. 1 is a longitudinal section view illustrating one embodiment of the fuel injection pump according to the present invention.

Referring to FIG. 1, a fuel injection pump is of the type designed to be directly mounted on the body of a Diesel engine, and includes a pump body 1 formed of, e.g., an aluminium alloy. The pump body 1 is provided therein with an assembly hole 2 extending in the longitudinal direction, which receives a plunger barrel 3 at the upper portion thereof. The plunger barrel 3 is formed of hardened steel, and includes an upper barrel 3*a* and a lower barrel 3*b* which are welded or otherwise bonded at their ends. The upper barrel 3*a* is joined at the upper end to a mounting plate 4 by, for example, caulking, and the result is then secured onto the upper face of the pump body 1 by means of a mounting bolt 5, whereby the plunger barrel 3 extends into the pump body 1.

The upper and lower barrels 3*a* and 3*b* are coaxially provided with plunger insertion holes 7*a* and 7*b*, and a recess 6 extends therebetween which is formed in the upper barrel 3*a*. A plunger 8 is slidably inserted into the holes 7*a* and 7*b*, and a fuel-pressurizing chamber 9 is defined thereabove. More specifically, the chamber 9 is defined by the plunger insertion hole 7*a*, the plunger 8, a valve seat member 10 and a delivery valve 11. The valve seat member 10 is located between the upper barrel 3*a* and a valve holder 12 threaded onto the upper barrel 3*a*, and receives the delivery valve 11 thereon. The delivery valve 11 is biased by a valve spring 13 resiliently interposed between it and the valve holder 12. An increase in the pressure prevailing in the fuel-pressurizing chamber 9 causes the delivery valve 11 to be raised against the action of the valve spring 13, so that an amount of fuel is discharged through a discharge port 14 formed in the upper end of the valve holder 12.

The lower end of the plunger 8 engages a lower spring seat 16, and abuts against a tappet 17 through a shim 16. The tappet 17 carries a roller 18, which engages a cam, not illustrated for the purpose of simplification, which received a driving force from an associated engine.

A return spring 19 is resiliently interposed between the lower spring seat 15 and an upper spring seat 20, and a return force exerted thereby acts upon the plunger 8.

A member 21 for adjusting the amount of fuel to be injected (hereinafter referred to as the injection adjusting member 21) is rotatably mounted at the lower portion of the lower barrel 3*b*, and engages a face portion 8*a* formed on the plunger 8 for providing only axial movement thereof. The injection adjusting member 21 is also connected with a first control rod 23, and the plunger is rotated via the injection adjusting member 21.

Figure 2:
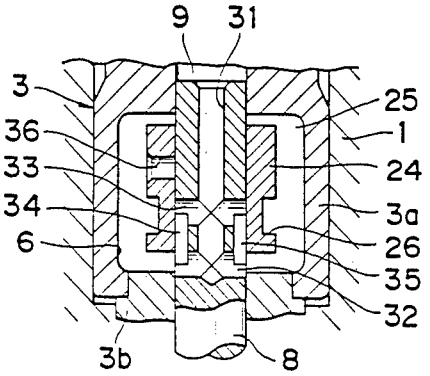
FIG. 2 is a sectional view taken along line II—II of FIG. 1.
Figure 3:
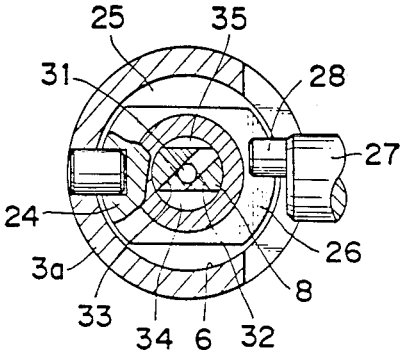
FIG. 3 is a sectional view taken along line III—III of FIG. 1.
Figure 4:
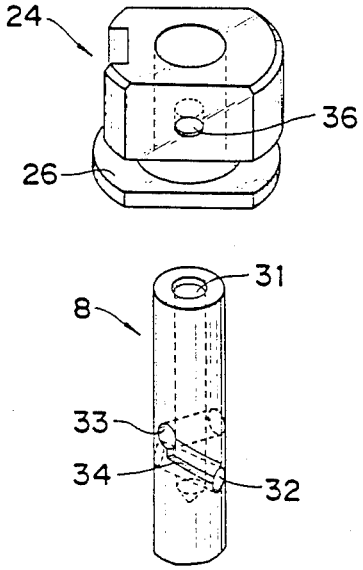
FIG. 4 is a perspective view showing the plunger and control sleeve of that embodiment.
Figure 5:
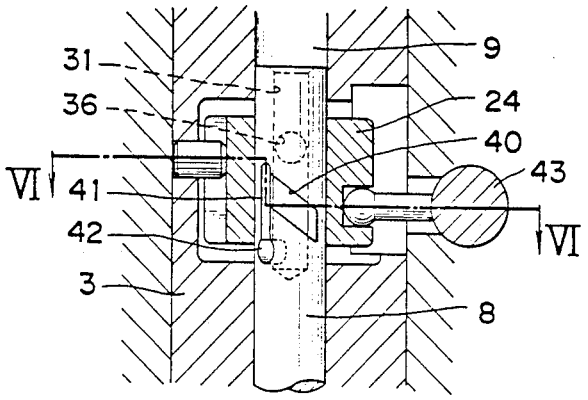
FIG. 5 PRIOR ART
FIG. 5 is a longitudinal section view showing one example of the prior art.
Figure 6:
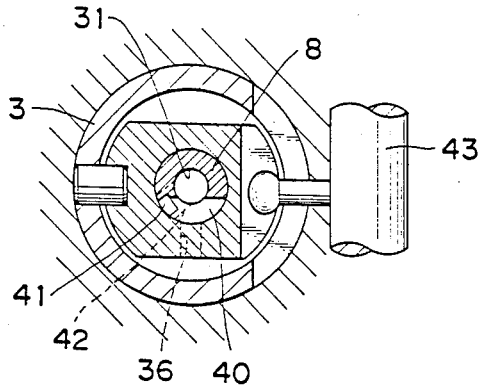
FIG. 6 PRIOR ART
FIG. 6 is a sectional view taken along line VI—VI of FIG. 5.

Within a fuel reservoir chamber 25, a control sleeve 24 is slidably fitted over the plunger 8, as illustrated in FIGS. 2 to 4. Except for one side, the fuel reservoir chamber 25 is defined by the recess 6 formed in the upper barrel 3*a*, and is connected to a fuel inlet and a fuel return port (not shown) formed in the pump body 1. The control sleeve 24 is also provided on the outer circumference thereof with a circumferentially lateral groove 26. Engaged within the groove 26 is an eccentric pin 28 of a connecting member 27. The connecting member 27 is rotatably inserted into the pump body 1, and is provided with an eccentric pin 28 at one end and with a second ball-like protrusion 29 at the other flange-like end. A second control rod 30 engages the second protrusion 29, and is moved to permit vertical movement of the control sleeve 24 via the connecting member 27.

The plunger 8 is provided with a longitudinal hole 31 which is open at one end to the fuel-pressurizing chamber 9, first and second lateral holes 32 and 33 which are connected to the outer hole 31 and are open to the side surface of the plunger 8, and first and second inclined grooves 34 and 35 for connecting openings of the first and second lateral holes 32 and 33. The longitudinal hole 31 has a diameter that ensures at least a minimum flow rate of fuel for injection. The first lateral hole 32, located at a lower position, is used to set the initiation timing of injection. The initiation timing of injection is the time from when the plunger 8 ascends until the first lateral hole 32 is closed by the control sleeve 24. The second lateral hole 33 maintaining the fuel in a noninjected state. The plunger 8 is in operable association with a cut-off port 36 formed in the control sleeve 24 when the plunger 8 is rotated to bring the second lateral hole 33 and the cut-off port 36 into alignment on the same plane. The plunger 8 ascends until the first lateral hole 32 is closed by the control sleeve 24 and, at the same time, the second lateral hole 33 and the cut-off port 36 communicate, whereby fuel is maintained in a noninjected state. The first and second lateral holes 32 and 33 are formed at right angles with respect to each other, and are open at both their ends on the outer face of the plunger.

The first inclined groove 34 is used to set the termination of fuel injection, and is provided on the side of the control sleeve 24 on which the cut-off port 36 is formed. When the plunger 8 ascends until the first inclined groove 34 registers with the cut-off port 36 in the control sleeve 24, the fuel-pressurizing chamber 9 and the fuel reservoir chamber 25 communicate via the longitudinal hole 31, the first and second lateral holes 32 and 33 and the first inclined groove 34 in the plunger 8 as well as the cut-off port 36 in the control sleeve 24, thereby terminating the injection of fuel. The second groove 35 is provided on the side of the plunger 8 on which the cut-off port is not formed and takes no part in the control of fuel injection. However, the second groove 35 is provided to prevent over-rotation of the plunger 8. In other words, when the first inclined groove 34 is in registration with the cut-off port 36, highly pressurized fuel in the fuel-pressurizing chamber 9 is returned to the fuel reservoir chamber 25 through the longitudinal hole 31, the first and second lateral holes 32, 33 and the first groove 34 in the plunger 8 as well as the cutoff port 36 in the plunger 8. However, when the fuel passes through the first and second lateral holes 32 and 33, it strikes upon the inner face of the control sleeve 24. In the arrangement wherein only one end of each of the lateral holes 32 and 33 is open on the outer surface of the plunger 8, the highly pressurized fuel is injected only from one side, so that the resulting counterforce tends to cause over-rotation of the plunger 8. For that reason, the instant embodiment is designed in such a manner that both ends of the lateral holes 32 and 33 are open on the outer surface of the plunger 8 to receive the aforesaid counterforce from both sides and the second inclined groove 35 corresponding to the first inclined groove 34 is provided on the opposite side of the plunger 8 to equally receive the aforesaid counterforce from both sides and, hence, relieve it.

It is understood that the cut-off port 36 is open to the inner face of the recess 6 in the upper barrel 3*a* formed of hardened steel. Thus, since an amount of fuel returning from the cut-off port 36 to the fuel reservoir chamber 25 strikes upon the upper barrel 3*a*, it is possible to prevent that fuel from striking directly upon the pump body 1 formed of an aluminium alloy, resulting in improvements in the durability thereof.

In the arrangement as mentioned above, when the roller 18 receives an upward force produced by the associated engine from the state shown in FIG. 1 and acting through a cam which is not illustrated, the plunger 8 ascends together with the lower spring seat 15, the shim 16, the tappet 17 and the roller 18 against the action of the return spring 19. In this case, however, since the first lateral hole 32 in the plunger 8 remains open within the fuel reservoir chamber 25, so that the fuel-pressurizing chamber 9 and the fuel reservoir chamber 25 communicate via the longitudinal hole 31 and the first lateral hole 32 in the plunger 8, there is no increase in the pressure of the fuel-pressurizing chamber 9, so that the delivery valve 11 remains closed, resulting in no pumping of fuel.

Further ascent of the plunger 8 causes the first lateral hole 32 in the plunger to be closed by the control sleeve 24. The communication between the fuel-pressurizing chamber 9 and the fuel reservoir chamber 25 is then shut down, leading to an increase in the pressure of fuel contained in that chamber 9. As a result, the delivery valve 11 is opened against the action of the valve spring 13, so that an amount of fuel contained in the fuel-pressurizing chamber 9 starts to discharge through the discharge port 14. This period of time represents the initiation timing of injection. It is noted that the prestroke is then defined as the amount of lifting or ascent of the plunger until the initiation of injection takes place.

Still further ascent of the plunger 8 causes the first inclined groove 34 in the plunger 8 to communicate with the cut-off port 36 in the control sleeve 24, and the fuel-pressurizing chamber 9 and the fuel reservoir chamber 25 again communicate through the longitudinal hole 31, the first and second lateral holes 32 and 35 and the first inclined groove 34 in the plunger 8 as well as the cut-off port 36 in the control sleeve 24. The fuel filled in the chamber 9 then escapes into the fuel reservoir chamber 25 in association with the ascent of the plunger 8, resulting in a decrease in the pressure of the fuel-pressurizing chamber 9 and hence closing of the deliver valve 11. This represents the end of injection. It is noted that the effective stroke is defined by the amount of lifting of the plunger 8 from the initiation to the end of injection. At the end of fuel injection, highly pressurized fuel flows from both ends of the first and second lateral holes 32 and 33 onto the inner face of the control sleeve 24 corresponding to the first and second inclined grooves 34 and 35. As already mentioned, this serves to prevent over-rotation and hence seizing, etc. of the plunger 8.

When the plunger 8 shifts from the ascending to the descending stroke, there is a further decrease in the pressure of the fuel-pressurizing chamber 9, which, when the first lateral hole 32 in the plunger 8 is open to the fuel reservoir chamber 25, results in the suction of fuel from the chamber 25 into the chamber 9. In this manner, an additional amount of fuel is supplied into the fuel reservoir chamber 25 to restore it to the original condition.

The adjustment of the amount of fuel to be injected is effected by the movement of the first control rod 23. Upon moving this control rod 23, the injection adjusting member 21 is rotated, since the first protrusion 22 thereof engages the control rod 23. In addition, the plunger 8 is rotated to vary the circumferentially relative positions of the plunger 8 and the control sleeve 25, since the face portion 8*a* of the plunger engages the injection adjusting member 21. For that reason, there is a change in the position where the first inclined groove 34 in the plunger 8 registers with the cut-off port 36 in the control sleeve 25, so that the effective stroke is varied to adjust the amount of fuel to be injected. It is noted that, when the plunger 8 is rotated in such a manner that the second lateral hole 33 in the plunger 8 is flush with the cut-off port 36 in the control sleeve 25, fuel remains noninjected.

The adjustment of injection timing is effected by the movement of the second control rod 30. Upon moving the second control rod 30, the connecting member 27 is rotated due to the fact the said control rod 30 engages the second protrusion 29 of the connecting member 27. In addition, since the eccentric pin 28 of the connecting member 27 engages within the lateral groove 26 in the control sleeve 25, the control sleeve 25 is vertically displaced to bringing about a change in the prestroke, by which the adjustment of injection timing is effected.

Obviously, many modifications and variations of the present invention are possible in light of the above teachings. It is therefore to be understood that within that the scope of the appended claims, the invention may be practiced otherwise than as specifically described.

What is claimed is:

1. A fuel injection pump comprising:

a plunger for injecting fuel; and a control sleeve extending around said plunger along the outer surface thereof and slidable relative to the outer surface for controlling the injection of fuel by said plunger, said control sleeve having a cut-off port open at the inner surface thereof, said plunger having a longitudinal hole extending axially therein and open at an upper end thereof, a first lateral hole extending therein from said longitudinal hole to an end that is open to the outer surface of the plunger, a second lateral hole extending therein from said longitudinal hole to an end that is open to the outer surface of the plunger, and an inclined groove extending along the outer surface of the plunger between and open to the respective ends of said lateral holes that are open to the outer surface of the plunger, said inclined groove extending in a direction that is inclined relative to the direction in which said longitudinal hole extends, said inclined groove for communicating with said cut-off port when the plunger is slid over a distance relative to the control sleeve, the distance over which the plunger must be slid to communicate the inclined groove with the cut-off port being adjustable by rotation of the plunger within the control sleeve.

2. The fuel injection pump as claimed in claim 1, wherein said first lateral hole also extends between said longitudinal hole and another end that is open to the outer surface of the plunger, and said second lateral hole also extends between said longitudinal hole and another end that is open to the outer surface of the plunger.

3. A fuel injection pump comprising:

a plunger for injecting fuel; and a control sleeve extending around said plunger along the outer surface thereof and slidable relative to the outer surface for controlling the injection of fuel by said plunger, said control sleeve having a cut-off port open at the inner surface thereof, said plunger having a longitudinal hole extending axially therein and open at an upper end thereof, a first lateral hole open to said longitudinal hole and extending through said plunger between first and second ends that are open to the outer surface of the plunger, a second lateral hole open to said longitudinal hole and extending through said plunger to respective first and second ends that are open to the outer surface of the plunger, a first inclined groove extending along the outer surface from one of said ends of the first lateral hole to one of said ends of the second lateral hole, and a second inclined groove extending along the outer surface of the plunger from the other of said ends of the first lateral hole to the other of said ends of the second lateral hole.

* * * * *